US005938053A

United States Patent [19]

Verbovszky et al.

[11] Patent Number: 5,938,053

[45] Date of Patent: Aug. 17, 1999

[54] CHILD'S BOTTLE AND FOOD CONTAINER

[76] Inventors: Esther Verbovszky, 325 N. Falmouth Dr., Rocky River, Ohio 44116; Carl J. Myers, 7816 Little Mt., Mentor, Ohio 44060

[21] Appl. No.: 08/628,948

[22] Filed: Apr. 8, 1996

[51] Int. Cl.[6] ..... A61J 9/00; A61J 11/04; A47G 19/22; A47G 21/04

[52] U.S. Cl. ..... 215/6; 215/11.1; 215/387; 215/388; 215/391; 215/11.4; 215/DIG. 5

[58] Field of Search ..... 215/11.1, 11.4, 215/11.5, 6, 387–389, 391, DIG. 5

[56] References Cited

U.S. PATENT DOCUMENTS

| | | | |
|---|---|---|---|
| 557,352 | 3/1896 | Bender | 215/6 X |
| 2,372,281 | 3/1945 | Jordan | 215/11.5 |
| 2,388,915 | 11/1945 | Heilborn | 215/11.1 |
| 2,594,114 | 4/1952 | Barcate | 215/11.1 |
| 2,665,816 | 1/1954 | Anft | 215/6 X |
| 2,746,634 | 5/1956 | Smith | 215/6 X |
| 2,843,281 | 7/1958 | Gallois | 215/6 X |
| 4,098,397 | 7/1978 | Mann, Jr. et al. | 215/6 X |
| 4,600,111 | 7/1986 | Brown | 215/6 |
| 4,623,069 | 11/1986 | White | 215/11.1 |
| 4,850,496 | 7/1989 | Rudell et al. | 215/11.1 X |
| 4,856,995 | 8/1989 | Wagner | 215/11.1 X |
| 4,979,629 | 12/1990 | Askerneese | 215/11.1 |
| 5,060,811 | 10/1991 | Fox | 215/6 |
| 5,150,800 | 9/1992 | Sarter et al. | 215/11.1 X |
| 5,593,052 | 1/1997 | McGee | 215/6 X |

FOREIGN PATENT DOCUMENTS

| | | | |
|---|---|---|---|
| 637934 | 3/1962 | Canada | 215/11.1 |
| 23236 | 2/1981 | European Pat. Off. | 215/11.4 |
| 2067416 | 7/1981 | United Kingdom | 215/11.4 |
| 2270684 | 3/1994 | United Kingdom | 215/11.1 |

*Primary Examiner*—Sue A. Weaver

[57] ABSTRACT

A combination baby bottle and solid food compartment with spoon is adapted for use with a small child in the range of 3 months to 4½ years of age. The bottle is uniquely shaped for easy gripping by the child and is divided into multiple compartments for holding separate liquids. The compartments are accessed through a valve arrangement, and the liquids can be dispensed by means of a sipper, straws or a nipple. The nipple is adapted to simulate a woman's breast, with the texture of the surface area of the nipple extension and surrounding the extension having a raspberry effect. The food compartment fits on the bottom of the bottle in an inverted position to provide a wide base for the combination. The handle of the spoon is shaped to fit the contour of the bottle to which it is secured by a clip. The spoon is uniquely shaped to fit the child's mouth or oral cavity.

16 Claims, 7 Drawing Sheets

CHILD'S BOTTLE AND FOOD CONTAINER

BACKGROUND OF THE INVENTION

This invention relates to a feeding bottle for a child. More particularly, it relates to a multiple compartment feeding container of the type useful for children in the range of 3 months to 4½ years of age. The container is of the type capable of holding and separately dispensing two or more separate liquids through a nipple, a sipper or a straw. The container also has a bottom compartment for containing and disposing solid or pureed food.

BRIEF SUMMARY OF THE INVENTION

One of the objectives of the present invention is to provide a two compartment bottle for holding two liquids at the same time, thereby allowing a child to access one or the other liquid through a dual straw action or a nipple or a sipper without spillage.

Another objective is a container bottle which holds two separate liquids, which is uniquely shaped for easy gripping, and which includes a wide base for stability. The base forms a separate bottom compartment to hold either dry or pureed food.

Still another objective is a nipple useful with a baby bottle, which nipple simulates a mother's breast with regard to size, shape and texture.

This invention relates to a combination baby bottle and food container comprising a liquid container comprising at least two separate compartments, separated by one another by a vertically extending wall, and a separate container for holding dry food forming the base for the liquid container. The liquid container is preferably shaped to facilitate gripping by a baby or infant. The liquids are selectively dispensed from one of the compartments using a straw, a sipper cup or a nipple. The liquid is dispensed from a selected compartment through a rotatable valve which is actuated relative to a seal between an open and a closed position. The valve actuator includes a handle which is located at the top of the liquid dispenser, or at the bottom thereof where it is joined to a shaft or arm extending through the liquid container to rotatably engage the valve. The shaft extends through a tube contained within a vertically extending wall which serves to separate the liquid compartments from one another. The tube covers the shaft. The removable base of the liquid container includes a separate food compartment, a fixed cover having an access opening and a second cover having at least one access opening, a handle to rotate the second cover relative to the first cover to index the openings, and a storage cap closely fitting over the two covers.

This invention further relates to a combination baby bottle and food container having: a) a tubular bottle container for liquids divided into at least two longitudinal compartments, b) a food container detachably attached to the base of the tubular bottle container, adapted to hold food for dispensing with a spoon or fingers, said food container including a cover to hold food in the container until needed, c) a liquid dispensing means that allows for controlled release of liquid nourishment, d) a valve releasing actuator that selectively controls the release of liquids from any one of the longitudinal compartments, said actuator accessible from the top or the bottom of the bottle to release the liquid, e) a sealing valve and a seal to close the longitudinal compartments and to avoid leakage of liquid therefrom, f) vents in the seal to allow air to control the flow of liquid from the bottle container by movement of said actuator relative to the sealing valve and seal. The invention also encompasses a uniquely designed spoon adapted to be clipped to the side of the container for easy access. The combination includes a cap covering the liquid dispenser, the cap including a pocket which is inverted when the cap is in place. The base likewise includes a pocket, the two pockets cooperating to hold the spoon when not in use. A clip can also be mounted on the side of the bottle to hold the spoon by its handle. The liquid compartments are sealed against leakage using a seal which cooperates with the valve. An actuator is manipulated, preferably by a handle, to rotate the valve relative to the seal to allow liquid to be selectively dispensed from one of the liquid compartments. The handle may be at the top of the baby bottle, being accessible with the cap removed. Alternatively, the handle is at the bottom of the bottle and is joined to the valve by a shaft extending through the liquid container whereupon rotating the handle at the bottom actuates the valve at the top. The handle is accessible by removing the base from the liquid container. The base of the second container includes a food compartment, a fixed cover having an access opening and a second cover having at least one access opening, a handle to rotate the second cover relative to the first cover to index the openings, and a cap closely fitting over the two covers.

The invention includes, in combination with a liquid container such as a baby bottle, a nipple for use in dispensing liquid from the container. The nipple is adapted to simulate a woman's breast with regard to size, shape and texture. The nipple includes a nipple extension and a series of openings on the top of the extension. The texture of the surface area of the nipple on top of, and surrounding the nipple extension, has a raspberry effect. The nipple is preferably composed of silicon latex plastic. The nipple is particularly useful with a liquid container having multiple liquid compartments, the container being contoured to be easily grasped by a baby or infant. A dry food compartment preferably forms the base of the liquid container.

DETAILED DESCRIPTION OF THE INVENTION

The invention relates to a multiple feeding container comprising a bottle having two or more liquid-containing compartments, and a bottom section that forms the base of the container and that holds dry, whole or pureed fold. The bottom section can be accessed by dialing the right proportion of food to be removed and a bottom lid or cap serving to prevent spillage in the purse. The device also includes a uniquely designed spoon which serves to initiate transition of a child from liquid to pureed foods. The spoon is designed for a young child's oral cavity. It is adapted to be secured on the side of the container when not in use.

The compact unit further includes three interchangeable multiple dispensing units. One of the units comprises dual straws; the second comprises a sipper cup and uses a three way flow controlling dispensing valve which eliminates the need for more than one sipper cup, which is spill proof and which allows flow of liquid from one drop to full flow. The valve is practical and economical, and is accessed either from the top or the bottom of the unit.

The babies bottle and food container is designed to meet the needs of a baby from a few weeks to 4½ years old. It is specially designed features allow care givers to provide two types of liquid i.e. milk or juice in two separate compartments with two separate accesses, dry or wet snack on the bottom when at home, on the run to provide instant versatility, accessibility and organization with gratification for mother and child.

There is a valve actuator in the bottom of the bottle that is accessible, once the bottom food compartment is removed, to permit the child or mother to switch the fluid containers to the open or closed position, using any of the three tops: nipple, sipper or straw depending on the need of the mother or child.

Figure 1:
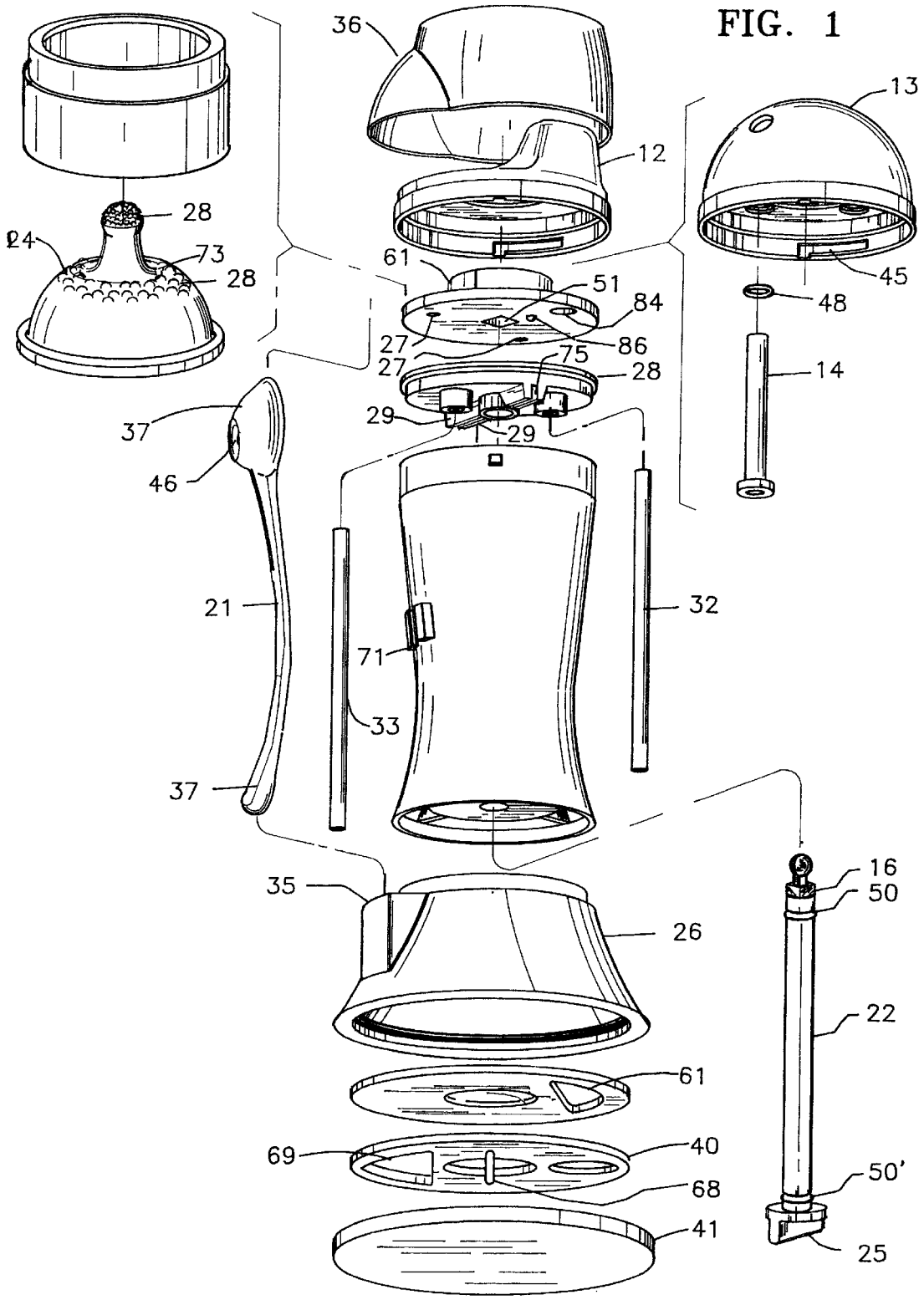
FIG. 1 is a composite drawing of 3 versions. On the left is a special nipple to simulate a women's anatomy. In the center is a sipper version and on the right is a straw version with 2 straws.

In FIG. 1, 10 is a cup covering the nipple 11, the sipper 12 or the straws 13, one of which is shown at 14.

On the left is the nipple 11 made of silicon latex plastic. This nipple is specially designed to simulate the mother's breast in size shape and texture around the orifice 16 and the tip 15 of the nipple. Observe too the nipple itself is to function in a natural manner.

The mother would use the dial/actuator 22 and handle 25 on the bottom of the bottle 24 to select.

Now for a description of the sipper version of FIG. 1, which is shown in the central core of FIG. 1. The mother has the option of using any one of the three versions. She would use the nipple on the left and leave out the sipper 12 on the other hand she could put the two straw version on the right and leave out the sipper 12 or the nipple 11.

To use the sipper 12, she would take off the cup 10, remove the food compartment 20, spoon 21 and turn valve actuator 22 which fits in and extends through a tube 23 in the plastic molded bottle 24. This valve actuator 22 has a square cross section at 16 which is the end of the actuator which fits into the axial hole 51 in sealing valve 19 and rotates the sealing valve 19 so that the child may take fluid from either compartment e.g. milk or juice. The valve actuator includes upper and lower seals 50, 50' which provide a fluid-tight fit in tube 23. Vents 27 were created to allow the child to go from drops to a dribble flow.

Below the valve 19 is the seal 28 having flanges 29 separated from one another by slot 75 which receives the wall 72 serving as a divider or barrier for the liquids in the respective compartments.

Tube 32 on the right and tube 33 on the left enter down into the lower reaches of each compartment so that suction will empty the entire compartment.

In the straw version 13 on the right, sipper 12 is taken out and the straw version is used in its place. Actuator 22 and its handle 25 are rotated to line up the straws. This depends on vacuum alone. The child creates a vacuum and fluid from one or the other compartment is sucked up. Bayonet joints 45 are used to fasten the straw version 13 to the bottle 24 and the food container to the bottle. Food container 20 has a pocket 35 to support spoon 21 and cup 10 has a inverted pocket 36 to support the opposite ends 37, 37' of the spoon. The spoon has a raised or indented center portion 46 to allow the child to take food off the center of the spoon.

In the food container are a series of layer 39–40 as well as a close fitting cap 41 to close off the compartment.

The combination of the narrow center in bottle 24 allows small hand of baby's to grasp the middle of the bottle tight.

There is a second straw on the opposite side of the hemispheric member 13.

Figure 2:
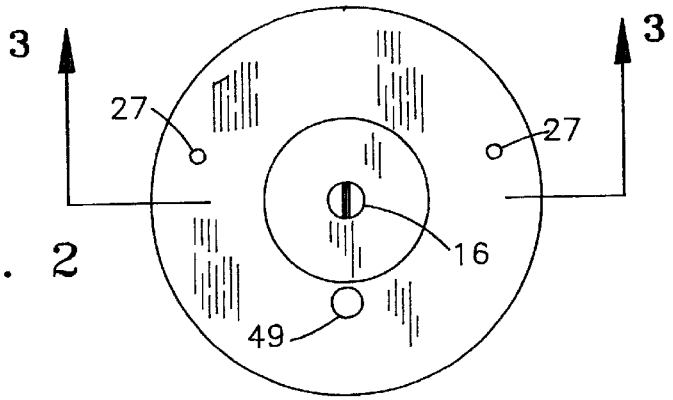
FIG. 2 is a top view of the seal for the nipple, sipper and straws.
Figure 3:
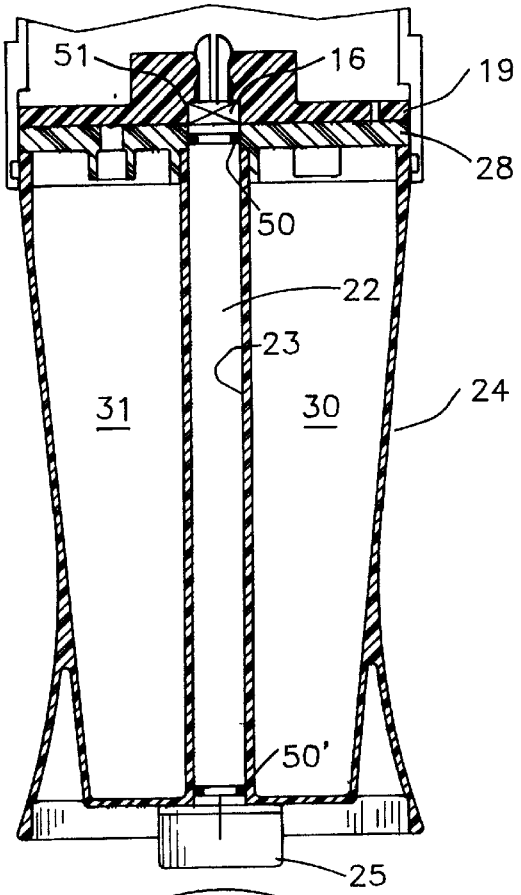
FIG. 3 is cross sectional view of the bottle compartment taken on line 3—3 of FIG. 2 showing the two compartments and the bottom actuator.
Figure 4:
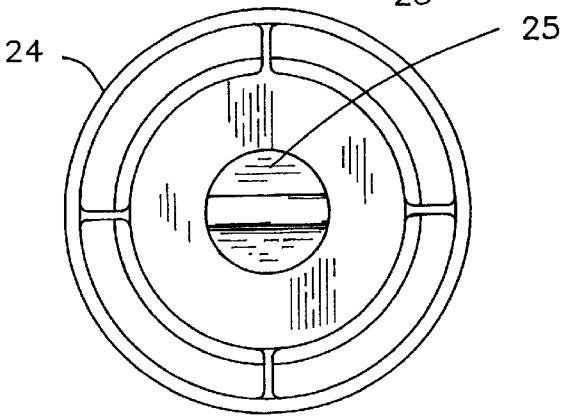
FIG. 4 is bottom view of the bottom actuator.

FIGS. 2, 3 & 4 show the relationship of the valve actuator 19 which controls the seal and the flow control opening for the seal when the mother or care giver moves the valve actuator so that the sipper will take fluid from the right compartment or the left compartment. As the handle 25 is moved there will be an opening 49 for fluid to be sipped by the child and a series of air vents. See FIG. 7.

Returning to other feature of the nipple and how it is used. The nipple simulated the mother's breast in having a nipple 15 with a series of opening on the top formed in the shape of a cross and the adjacent area has a roughened area sometimes called a raspberry effect 47. It is mounted with a plastic ring 18 which seals the latex flange 17 to the bottle 24. The actuator and seal fit under the nipple as shown in FIG. 1.

The straw version is sealed as shown at 14 with O-ring 48 which the mother pulls out to access each compartment separately.

To explain how this baby bottle and food compartment will work in practice let us go through a trip that the mother might take with her child. She would fill the two compartment bottle with milk and juice and a medicine if it was prescribed. At any period in the baby's development he or she would be on the nipple, the sipper or straws. The mother would assemble the bottle with the nipple leaving the sipper and straws in the case. When the baby cried wanting milk the mother would turn the valve actuator handle 25 which rotates actuator shaft 22 and the square head 16 to move the fluid opening 49 of valve 19 seen in FIG. 3 to the correct compartment either left or right. If for some reason the mother wished to shift to the other compartment for juice or medicine she would turn handle 25 to the other compartment.

If at different time the mother wanted to use the sipper she would assemble the sipper 12 on top of sealing valve 19 and seal 28 and move the actuator to be connected to the desired liquid compartment of the bottle.

The steps for the straw are different only in that the hemisphered member 13 is attached in place of the sipper 12. The other steps are the same.

Top Actuated Bottle

Figure 5:
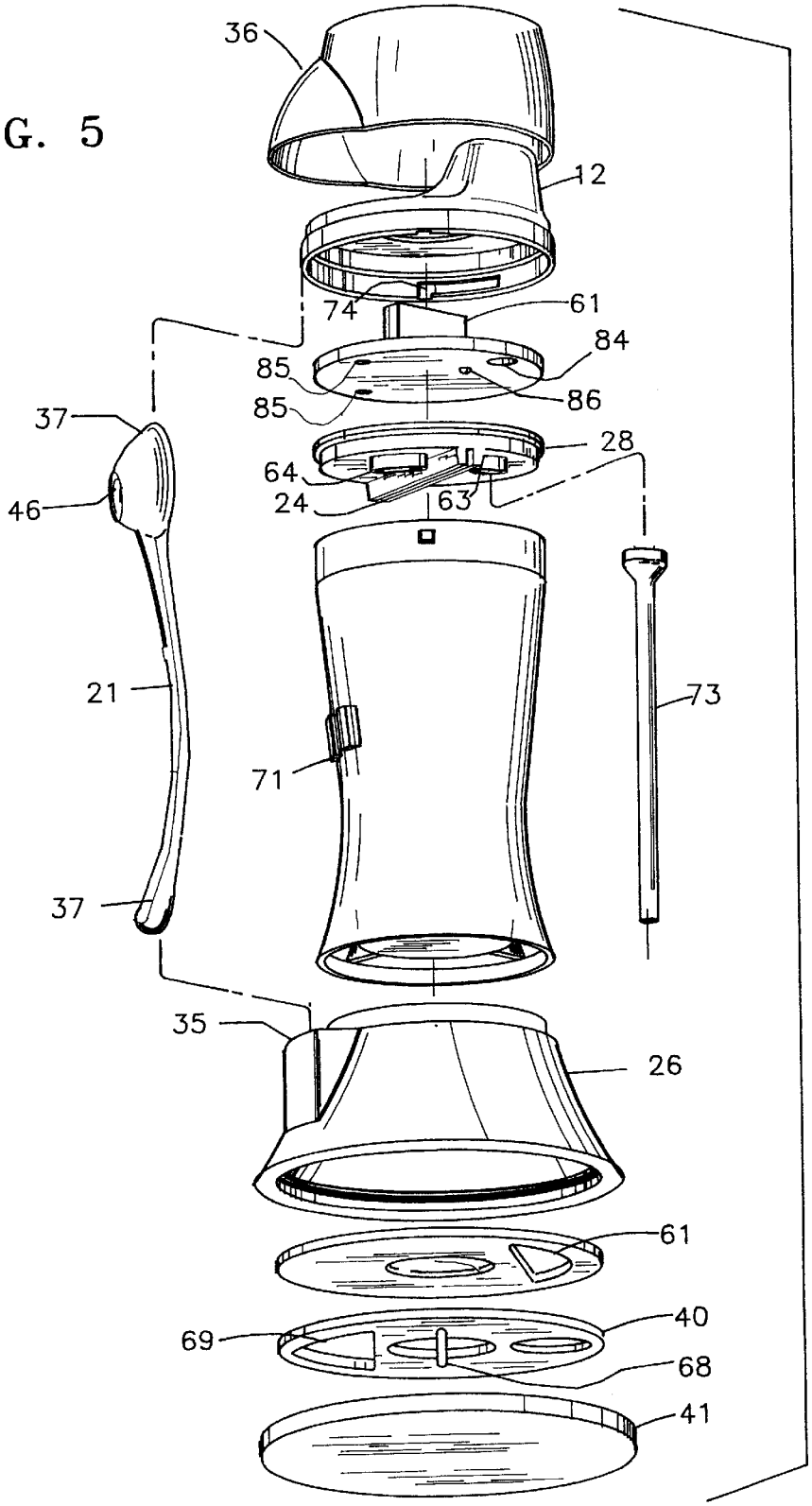
FIG. 5 is an exploded view of the top actuated sipper version. The nipple version of the bottom actuated in FIG. 1 would be similar as would the straw version on the right in FIG. 1.
Figure 6:
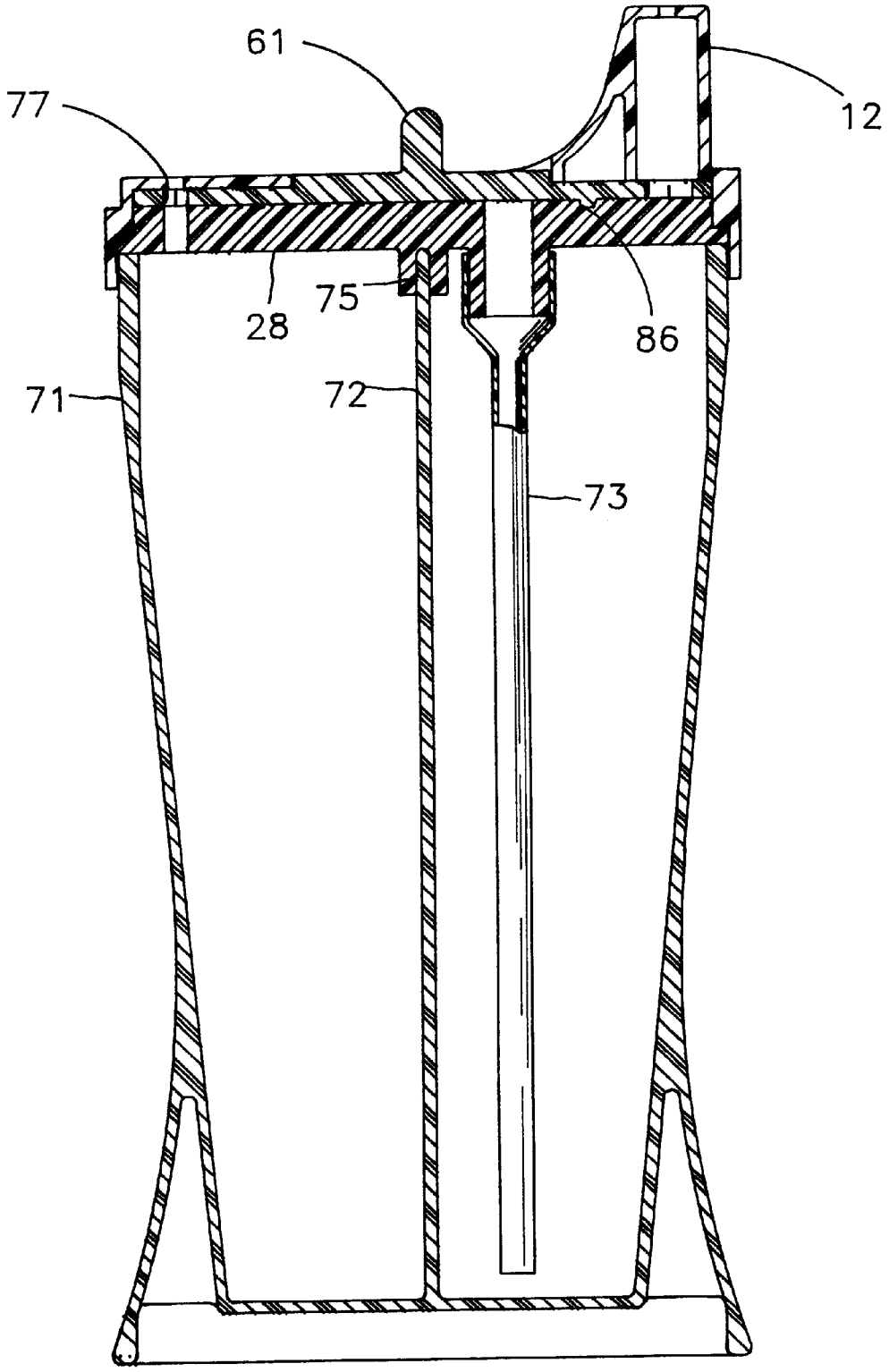
FIG. 6 is cross section view of FIG. 5. The sipper version seen in FIG. 5 showing 2 compartments for liquids but only one tube for emptying the right compartment. The left tube would be similar to the right tube.
Figure 7:
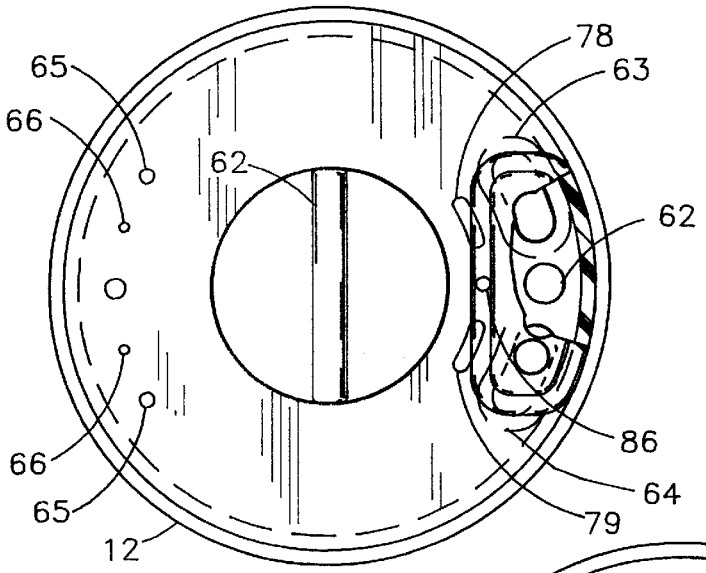
FIG. 7 shows the top actuating valve of FIG. 5 with the venting system.
Figure 8:
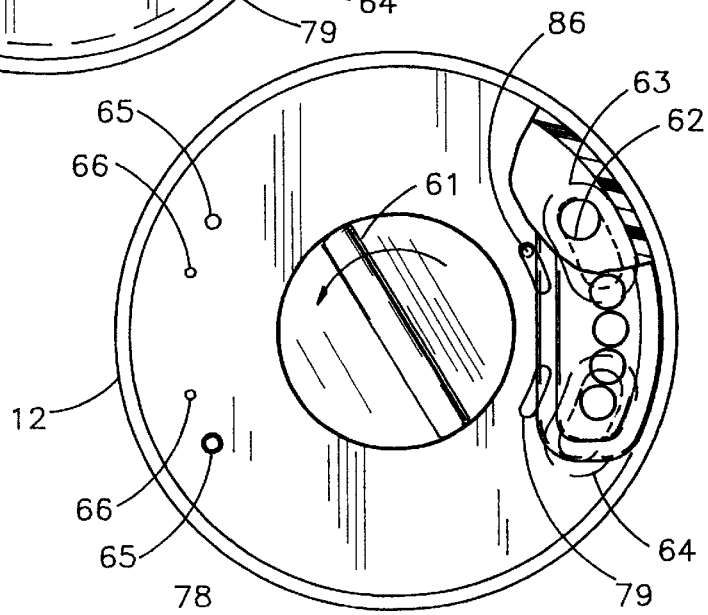
FIG. 8 show another view of the actuating valve and the seals for fluid control.
Figure 9:
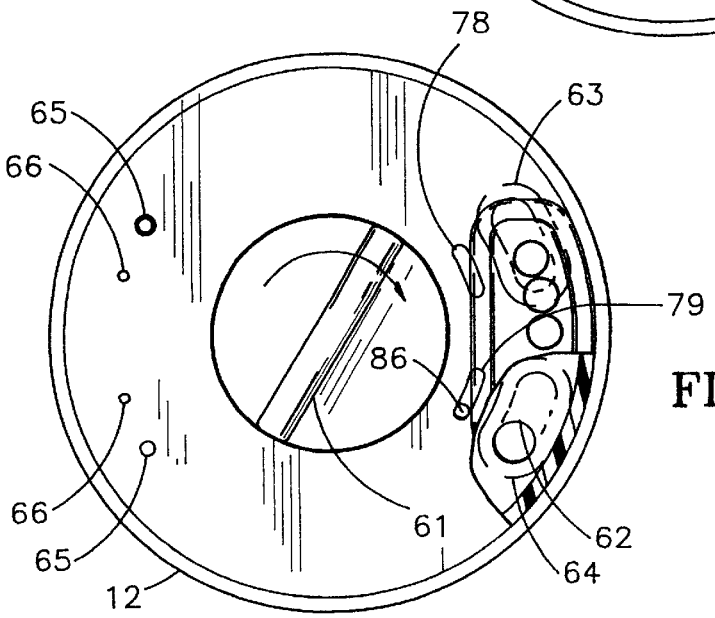
FIG. 9 shows another view of the operation of the flow control.

An alternative way to actuate the valve actuator describe in connection with FIGS. 1–4 is shown in FIGS. 5–15 where the valve actuator is moved by the care giver by turning the handle 61 to the right or the left to connect the fluid controls to the sipper 12 as shown in FIGS. 5 and 6. The details of how the control works is shown in FIGS. 7, 8 & 9. An outlet hole 62 is shown in FIG. 7 and another pair of oval shaped holes are shown at 63 and 64. These are connected all to the same compartment.

When the valve actuator handle 61 is moved to the right or left the fluid opening 62 is connected to the compartment supplying fluid to the child as he or she sips the fluid. On the opposite side of the valve 19 are a series of vent holes 65, 66 of different size. These allow controls so that the liquid the child receives can be controlled. Detent 86 (shown more clearly in FIG. 15) is midway between slots 78, 79 when handle 61 is in the 'off' position. As the handle is turned to the left, the detent reaches and enters slot 78 (see FIG. 8) to form a positive registry. In like manner, registry of the detent in slot 79 (as shown in FIG. 9) is achieved when the handle is turned clockwise to the right.

FIG. 8 shows one variation in the holes in the seal 28 illustrated. See vents 65 (large) and 66 smaller). FIG. 9 shows a move clockwise with the varieties to the vents which are large, medium and small. The seal is fixed to the center divider and does not rotate. The valving works the same whether it is activated from the top or the bottom.

The food container for solid food is shown at 20. The food container is first removed from the bottom of the bottle and is inverted to feed the child. There is a fixed opening cover 39 and a small handle 68 to rotate cover 40 so that opening 69 can register with opening 70 so that a spoon or small fingers may pass through the opening and the child can be self fed or feed themselves. When the child is full the process is reversed and cover 41 is positioned to seal the food container.

FIG. 6 shows a cross sectional view of the bottle divided into two compartment with a wall 72 dividing the bottle into two compartments. There is a tube 73 reaching into the bottom of one compartment and a similar tube for the other compartment.

Figure 10:
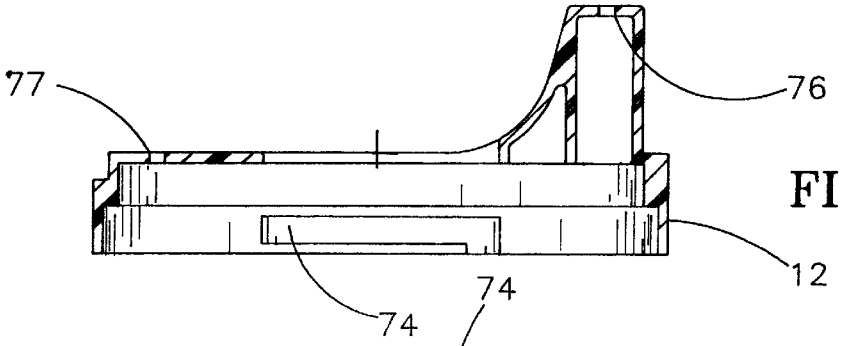
FIG. 10 shows a cross sectional view of the sipper of FIG. 11 along the line of 10—10 of FIG. 11
Figure 11:
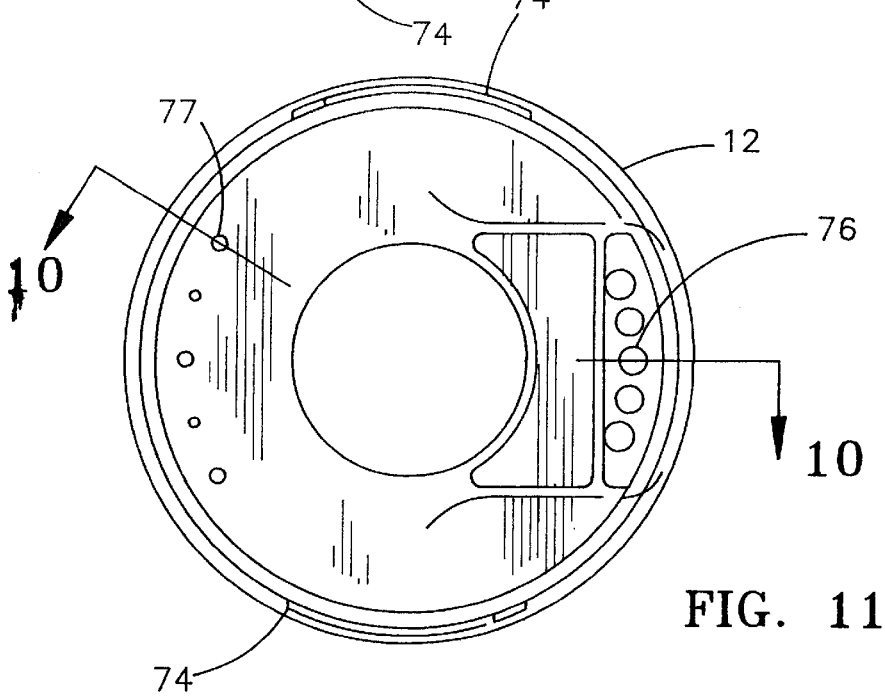
FIG. 11 shows a view of the sipper and the seals and vents for the bottle
Figure 12:
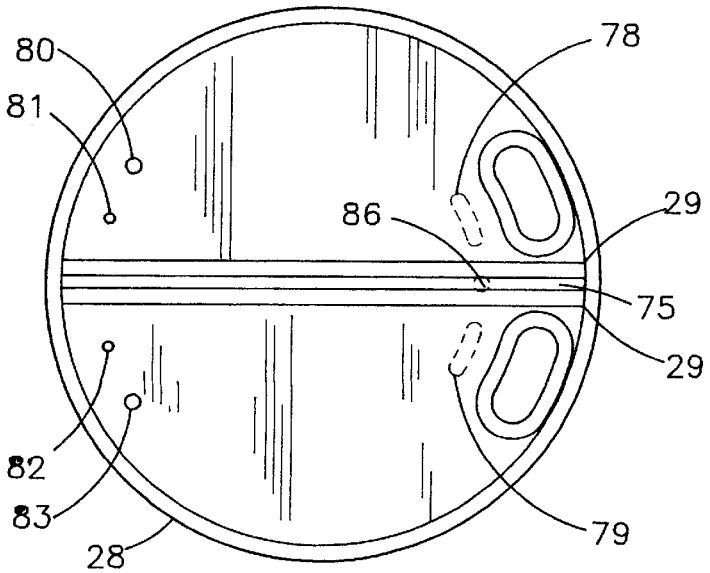
FIG. 12 shows a bottom view of the seal and the compartment divider seen in FIG. 5
Figure 13:
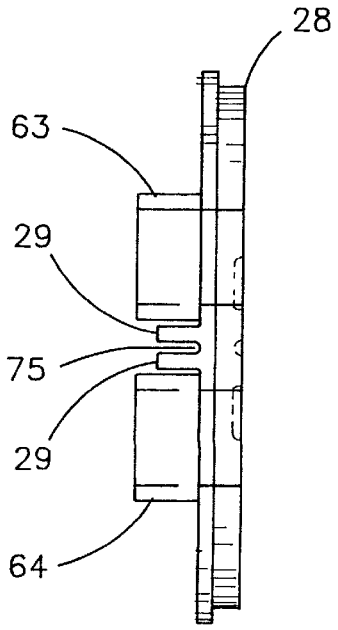
FIG. 13 shows a side view of the seal and the compartment divider as well as the tubes that extend to the bottom of each compartment.

FIG. 10 shows details of the sipper in cross section with the bayonet lock at 74. A top view of the sipper is shown in FIG. 11 with an opening at 76 for sipping and at least one vent hole at 77 movement over the other hole will reduce the flow of liquid but allow the child to continue to suck. FIG. 12 is a bottom view of the seal showing the compartment divider and the outlet that holds tube 73 extending down into the bottle compartment. A series of vents for such compartment are shown at 80-and 81 and at 82 and 83 for the other compartment. FIG. 13 shows seal 28 with flanges 29, and slot 75 into which the vertical compartment divider (not shown) fits. Also shown are oval holes 63, 64 adapted to be engaged by straws (not shown).

Figure 14:
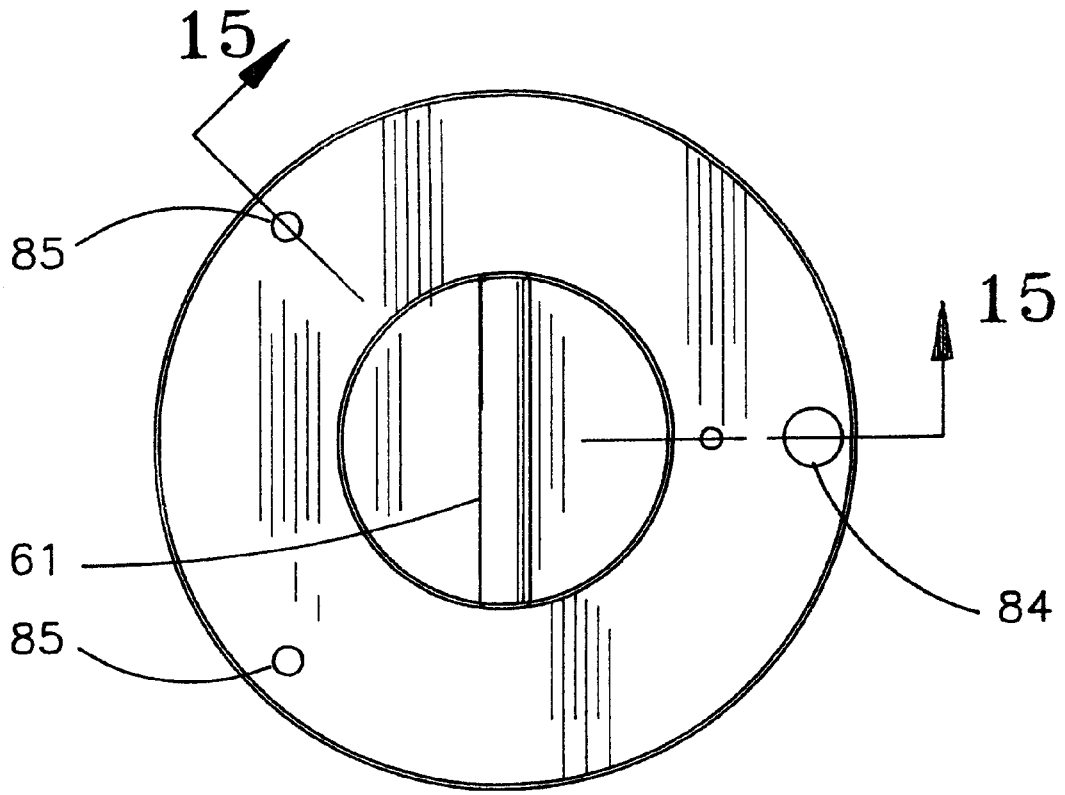
FIG. 14 is a top view of the valve actuator. The flow control opening for the vents and the liquid
Figure 15:
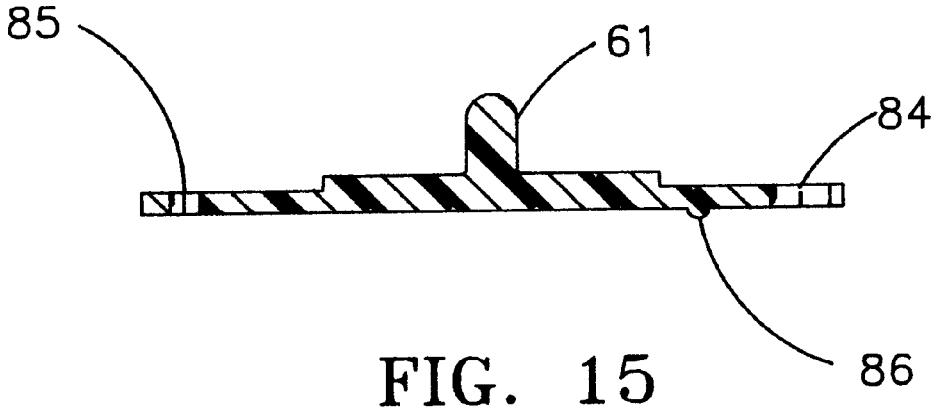
FIG. 15 is a cross sectional view of the actuator along the line 15—15 of FIG. 14

FIG. 14 and FIG. 15 show the details of the valve actuator with its handle 61 and the flow control opening 84 and vents 85.

The top actuated version operates similar to the bottom actuated except for the fact that the bottle must be opened or loosened slightly to release seal pressure to operate the actuator 61.

FIGS. 1–4 show the bottom actuator version and the remaining figure shows a top actuated version. This three-way flow controlling dispensing valve is not only intended for exclusive use with children, but with the option to be used medically in the long run with all ages that develop any type of swallowing malfunction. Changes may be made in size and proportions to suit these individual's needs. Thirdly, there is a uniquely designed nipple which is patterned after and encompasses the human mother's breast as close as possible. This specially designed nipple keeps the baby and mother's needs in mind. It presents the infant with a nipple that resembles the mother's breast in regard to shape and texture and nothing could resemble this closer, except for the real thing. The nipple can access the two liquids by a simple rotation from the bottom of the bottle moving the valve actuator. This allows for hygienic qualities that will enable mothers to switch liquids on their baby if needed. For example, medicine may be in one compartment and milk in the other which allows for an easy transition from medicine to liquid food. Therefore, this nipple is not only created for marketing purposes, per se, to meet the public need, but it entails pediatrician ramifications with its unique hygienic bottom control dispensing valve. This complete unit was created as a whole. However, it can be separated from each other without departing from the spirit or sacrificing any advantages of the invention.

We claim:

1. A combination baby bottle and food container comprising a) a first liquid container having a shape adapted to be grasped by the hands of an infant, said container comprising at least two separate compartments;

b) a base to which said liquid container is joined, the base comprising a second container for holding solid or pureed food;

c) a spoon adapted to be used for dispensing food from the second container;

d) means to removably attach the spoon to the outside of the liquid container;

e) means for dispensing liquid from a single compartment of the first container, said means selected from the group consisting of a sipper cup, a nipple and a straw;

f) a rotatable valve in communication with the separate compartments of the liquid container; and g) an actuator engaging the valve to rotate the same for alternately sealing the liquid compartments or permitting controlled removal of liquid from a single compartment.

2. The combination according to claim 1 wherein the compartments in the liquid container are separated from one another by a vertically extending wall.

3. The combination according to claim 1 wherein said spoon includes a handle shaped to fit the contour of the liquid container.

4. The combination according to claim 3 wherein the spoon is shaped to fit the structure of a child's oral cavity.

5. The combination according to claim 3 further including a cap covering the liquid dispensing means when not in use, said cap including an inverted pocket, and said base including a pocket, the two pockets cooperating to hold the spoon during storage.

6. The combination according to claim 5 wherein the spoon is removably attached to the liquid container with a clip.

7. The combination according to claim 1 further including a seal which cooperates with the valve to seal the liquid compartments, and the actuator is adapted to be manipulated to rotate the valve relative to the seal to allow liquid to be selectively dispensed from one of the compartments.

8. The combination according to claim 7 wherein the actuator includes a handle for selective manipulation of the valve between an open and a closed position.

9. The combination according to claim 8 wherein the means for dispensing liquid from a single compartment is a sipper cup, the actuator is a handle at the top of the liquid container, a cap covers the sipper cup when not in use, the handle being accessible with the cap removed from the lid.

10. The combination according to claim 8 wherein the handle is at the bottom of the liquid dispensing means, is joined to a shaft extending through the liquid container to engage the valve, and is accessible upon removal of the base from the liquid container.

11. The combination according to claim 10 wherein the compartments of the liquid container are separated by a vertically extending wall, the wall contains a tube extending the vertical length of the wall, and the shaft extends through the tube from the handle to the valve.

12. A. The combination according to claim 1 wherein the second container includes a food compartment, a fixed cover having an access opening and a second cover having at least one access opening, means to rotate the second cover relative to the first cover to index the openings, and a cap closely fitting over the two covers to prevent spillage of the contents from the food compartment.

13. A combination baby bottle and food container comprising, a) a liquid container comprising at least two separate compartments;

b) a separate container for holding dry or pureed food and forming the base for the liquid container;

c) a sipper cup for selectively dispensing liquid from one of the compartments of the liquid container;

d) a valve for alternately sealing the liquid compartments or permitting controlled removal of liquid through the sipper cup from one of the liquid compartments;

e) a seal which cooperates with the valve to seal the liquid compartments;

f) a valve actuator adapted to be manipulated to rotate the valve relative to the seal to allow liquid to be selectively dispensed from one of the compartments, the actuator including a handle located at the top of the liquid container for selective manipulation of the valve between an open and a closed position; and g) a removable cap covering the sipper cup and the handle when not in use, the handle being accessible when the cap is removed.

14. A combination baby bottle and food container comprising:

a) a liquid container comprising at least two separate compartments;

b) a separate container for holding dry or pureed food and forming the base for the liquid container;

c) means for selectively dispensing liquid from one of the compartments of the liquid container, said means selected from the group consisting of a sipper cup, a nipple and a straw;

d) a valve in communication with the separate compartments of the liquid flow control;

e) a valve actuator including a seal which cooperates with the valve for alternately sealing the liquid compartments or permitting controlled removal of liquid through the selective dispensing means from one of the liquid compartments;

f) a handle to manipulate the valve actuator between an open and a closed position, said handle being accessible upon removal of the base from the liquid container; and g) a shaft extending through the liquid container to engage the valve and said handle.

15. The combination according to claim 14 wherein the compartments in the liquid container are separated from one another by a vertically extending wall.

16. The combination according to claim 15 wherein the wall contains a tube extending the vertical length of the wall, and the shaft extends through the tube from the handle to the valve.

* * * * *